US011649623B2

(12) United States Patent
Oberholzer et al.

(10) Patent No.: US 11,649,623 B2
(45) Date of Patent: May 16, 2023

(54) DRAIN ARRANGEMENT

(71) Applicant: GEBERIT INTERNATIONAL AG, Jona (CH)

(72) Inventors: Marco Oberholzer, Eschenbach (CH); Roman Culatti, Steinerberg (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 17/318,376

(22) Filed: May 12, 2021

(65) Prior Publication Data

US 2021/0355666 A1 Nov. 18, 2021

(30) Foreign Application Priority Data

May 13, 2020 (EP) ..... 20174356
May 13, 2020 (EP) ..... 20174359

(51) Int. Cl.
*E03C 1/232* (2006.01)
*E03C 1/242* (2006.01)
*E03C 1/23* (2006.01)

(52) U.S. Cl.
CPC ..... *E03C 1/232* (2013.01); *E03C 1/2304* (2013.01); *E03C 1/242* (2013.01)

(58) Field of Classification Search
CPC ..... E03C 1/232
USPC ..... 4/680–683, 654
See application file for complete search history.

(56) References Cited

U.S. PATENT DOCUMENTS 5,591,348 A * 1/1997 Felder ..... B01D 21/2427 210/221.1

FOREIGN PATENT DOCUMENTS

| | | | |
|---|---|---|---|
| DE | 8616387 | U1 | 3/1990 |
| EP | 2045403 | A1 | 4/2009 |
| EP | 2845957 | A1 | 3/2015 |
| FR | 2164018 | A5 | 7/1973 |
| SE | 1850878 | A1 | 4/2019 |
| WO | 2017/042537 | A1 | 3/2017 |
| WO | 2019/145051 | A1 | 8/2019 |

OTHER PUBLICATIONS

European Search Report of EP20174359.8 dated Sep. 30, 2020.
European Search Report of EP20174356.4 dated Oct. 6, 2020.

* cited by examiner

*Primary Examiner* — Lori L Baker
(74) *Attorney, Agent, or Firm* — Sughrue Mion, PLLC

(57) ABSTRACT

A drain arrangement that comprises a drain valve housing which has a first channel section with an inlet opening, a second channel section with an outlet opening, and a valve seat situated between the inlet opening and the outlet opening. There also is a valve body, an actuating unit by way of which the valve body is movable, and an outflow pipe into which the second channel section opens by way of the outlet opening thereof. A first central axis extends centrally through the first channel section, and an outflow pipe central axis extends centrally through the outflow pipe. The outflow pipe central axis intersects the first central axis, and the drain arrangement furthermore comprises an overflow unit, which has a first connecting pipe, an overflow pipe and a second connecting pipe.

19 Claims, 8 Drawing Sheets

DRAIN ARRANGEMENT

TECHNICAL FIELD

The present invention relates to a drain arrangement for a sanitary item, in particular for a washbasin or a sink, according to claim 1.

PRIOR ART

Drain arrangements for washbasins or sinks are known from the prior art.

For example, EP 2 045 403 discloses a drain arrangement having an overflow unit. The overflow unit extends by way of connecting pipes away from a drain valve housing and upwards counter to the plumb-line direction. In the downward direction, the drain valve housing has a pipe connector, which is followed by a siphon and a drain line.

Although EP 2 045 403 has numerous advantages, it is a disadvantage that the structural space covers a relatively large area in the downward direction, this being disadvantageous for the volume of a base cabinet which is to be arranged below the washbasin.

Various requirements for drain arrangements emerge from practical experience. For example, a key requirement is the compactness of a drain arrangement, so that the latter takes up only little installation space.

SUMMARY OF THE INVENTION

Taking this prior art as a starting point, it is an object of the invention to specify a drain arrangement which overcomes the disadvantages of the prior art. In particular, it is an object of the present invention to specify a drain arrangement which, in particular from the sanitary item downwards, is designed to be as compact as possible.

A drain arrangement according to claim 1 achieves this object. Accordingly, a drain arrangement for connection to a sanitary item comprises a drain valve housing which has a first channel section with an inlet opening, has a second channel section with an outlet opening, which is situated laterally with respect to the drain valve housing, and has a valve seat situated between the inlet opening and the outlet opening, a valve body which is movable from the valve seat from a closed position into an open position, an actuating unit by way of which the valve body is movable, and an outflow pipe which follows the outlet opening. A first central axis extends centrally through the first channel section, and an outflow pipe central axis extends centrally through the outflow pipe. In one variant, the outflow pipe central axis intersects the first central axis. In another variant, the outflow pipe central axis is at a distance from the first central axis, wherein the distance corresponds at most to half the diameter of the outlet opening.

The drain arrangement furthermore comprises an overflow unit, wherein the overflow unit has a first connecting pipe, an overflow pipe and a second connecting pipe. The first connecting pipe is led, from an upper mouth opening, out of the first channel section from above the valve seat. Furthermore, the first connecting pipe opens into the overflow pipe, which, in the installation position, extends upwards substantially counter to the plumb-line direction. The overflow pipe then opens, below the first connecting pipe, into the second connecting pipe, which opens, below the valve seat, into the first channel section, and/or the second channel section, via a lower mouth opening.

Both the outlet opening and the mouth openings are arranged at the outflow housing laterally with respect to the outflow valve housing, in such a way that, as seen in the installation position, the outflow pipe and the connecting pipes extend substantially next to one another. The outflow pipe and the connecting pipes extend and are situated laterally next to one another.

The lateral arrangement of the mouth openings at the outflow valve housing and the lateral arrangement of the outlet opening at the outflow valve housing, with the associated arrangement of the outflow pipe, yields the advantage that the required structural height of the drain arrangement can be minimized. In particular, it is possible to minimize the structural space from the sanitary item downwards, whereby the space below the sanitary item and the drain arrangement can be better used by a base cabinet or some other structure.

The expression "laterally with respect to the outflow valve housing" is to be understood as meaning that the mouth openings and the outlet opening are situated in a side wall of the outflow valve housing.

As seen in the installation position, the first central axis of the first channel section is substantially vertical or in the plumb-line direction.

The second channel section has a central axis, which extends centrally through the second channel section. The first central axis is at an angle of at least 90° to the second central axis or to the outflow pipe central axis. Particularly preferably, angles are between 90° and 95°. In the installation position, the second central axis or the outflow pipe central axis is therefore horizontal or slightly downwardly inclined with respect to the horizontal.

Preferably, the outflow pipe central axis is oriented so as to be substantially parallel to, in particular collinear with respect to, the second central axis.

Preferably, the valve seat is situated in the first channel section. The valve seat extends about the first central axis.

Preferably, the mouth openings are provided by in each case one mouth channel section, which mouth channel section extends in a manner inclined at an angle, in particular at an angle of 45° to 135°, particularly preferably at an angle of 90°, to the outflow pipe central axis.

In other words, the mouth channel sections each extend along a mouth central axis. The mouth central axes are inclined at an angle, in particular at an angle of 45° to 135°, particularly preferably at an angle of 90°, to the pipe central axis.

Preferably, the mouth openings are delimited at a face side by side edges. The side edges of the mouth openings lie in a common plane, which is parallel or at an angle of at most 45° to a central plane extending through the first central axis and the pipe central axis.

Preferably, the two connecting pipes extend laterally alongside and spaced apart from the outflow pipe, wherein, as seen in the installation position from above, the connecting pipe central axes are parallel to the outflow pipe central axis.

As seen from the side, the connecting pipe central axes may be parallel or inclined at an angle to the outflow pipe central axis.

Preferably, the connecting pipes each project with a pipe section into the mouth openings.

Preferably, a seal is arranged between the pipe section and the mouth opening.

Preferably, the seal has a section which is exposed in the mouth opening, wherein the section is in the form of an angled surface. In this way, a flow-optimized contour can be provided.

Preferably, a diversion section is provided between the mouth opening and the respective connecting pipe, wherein the diversion section is part of the mouth opening and/or part of the connecting pipe. By way of the diversion section, a diversion is achieved such that the two connecting pipes are able to extend laterally alongside the outflow pipe.

Preferably, in the installation position, the connecting pipe central axes are inclined at an angle with respect to a horizontal plane, wherein the connecting pipes descend towards the mouth openings. This yields the advantage that, in the case of an emergency overflow, the lower connecting pipe is formed with a downward incline, with the result that a good outflow can be provided.

Preferably, before the entry into the first channel section, the second connecting pipe and/or the lower mouth opening have/has a shoulder which is oriented downwards in the direction of gravitational force. By way of said shoulder, it is achieved that the connecting pipe, in the installation position, may be situated slightly higher. Furthermore, flow over the shoulder results in a slightly higher flow speed being achieved, which is a great advantage for the outflow.

The two connecting pipe central axes are preferably parallel to one another.

Preferably, the two connecting pipes are formed integrally with one another.

Preferably, the overflow pipe may be connected to the connecting pipes via a plug-in connection. The plug-in connection may furthermore have a seal.

The overflow unit is situated in a structural space, which structural space extends laterally with respect to the outflow pipe and in the upward direction. In the installation position, the structural space is bounded downwardly by a lower plane. The lower plane extends at right angles to a central plane, which is spanned by the first central axis and the second central axis. The lower plane furthermore extends through a lower lateral surface line, which forms the line of intersection of a vertical plane, extending through the outflow pipe central axis and vertically, with the pipe outer side. This arrangement has the advantage that a compact structure can be provided in relation to the structural height beneath the sanitary item.

The expression "structural space" is to be understood as meaning a spatial region in which the overflow unit is arranged.

Preferably, the outflow pipe extends along a straight line without curvature. Preferably, a siphon element follows the outflow pipe opposite the second channel section.

Preferably, the outflow pipe has a length of greater than 300 millimetres.

Preferably, furthermore, the actuating unit has an actuating lever, which acts on the valve body, and an actuator element for actuating the actuating lever, wherein the actuator element, at least over a section, extends laterally alongside the outflow pipe.

The lateral arrangement of the actuator element yields the advantage that a compact structure can be provided. That is to say that the height of the drain arrangement can be minimized, which reduces the space required below the sanitary item.

This lateral arrangement yields the further advantage that the water flowing away through the drain valve housing is diverted only between the first channel section and the second channel section and then, in one variant, flows directly into the outflow pipe and, in the other variant, undergoes a small diversion on account of the offset of the first central axis with respect to the outflow pipe central axis.

The expression "laterally alongside the outflow pipe" is to be understood as meaning that, in the installation position, the actuator element is situated alongside the outflow pipe and extends alongside the outflow pipe.

Preferably, the actuator element is situated on one side of the outflow pipe, and the two connecting pipes and also the overflow pipe are situated on the other side of the outflow pipe.

Preferably, the mouth openings are, in relation to a central plane spanned by the first central axis and the second central axis, situated opposite the actuator element.

Preferably, the actuator element is mounted in a bearing point situated on the outside of the drain valve housing, wherein the bearing point has a bearing opening for the passing-through of the actuator element. Here, the mounting is such that the actuator element is movable relative to the fixed bearing arrangement.

The bearing point is preferably formed integrally on the drain valve housing. The bearing point may however also be arranged on a separate element which can be connected to the drain valve housing.

The bearing point is situated laterally on the drain valve housing.

Preferably, in the installation position, the bearing point or the bearing opening is situated at a height which is central with respect to the outflow pipe.

Preferably, the actuator element is situated spaced apart laterally at a distance from the lateral surface of the outflow pipe, wherein the distance is less than the outer diameter of the outflow pipe, or wherein the distance is less than half the outer diameter of the outflow pipe.

The small distance from the outflow pipe yields the advantage that the required structural space of the drain valve arrangement in terms of its width can be minimized.

Preferably, the actuating lever has a lever axle, wherein the actuating lever is pivotable around the lever axle, and wherein the lever axle extends at right angles to the first central axis and to the second central axis.

Particularly preferably, as seen in the installation position, the lever axle is situated below the outflow pipe central axis.

Preferably, the lever axle is mounted in a bearing point in a side wall of the outflow valve housing, wherein the lever axle projects out of the outflow valve housing, and wherein the lever axle has, in particular at an end side, a lever projection with an articulation point on which the actuator element acts.

Preferably, the actuating lever has a lever arm which acts on the valve body. The lever arm projects away from the lever axle and is situated in the first and/or in the second channel section.

The position of the actuator element may be specified via a structural space. Preferably, the actuator element is situated in the structural space, wherein the structural space extends laterally with respect to the outflow pipe.

The expression "structural space" is to be understood as meaning a spatial region in which the actuator element is arranged.

Preferably, the lever projection is situated in a structural space, which structural space extends laterally with respect to the outflow pipe.

Preferably, the structural space is bounded laterally by the outer side of the outflow pipe and by a vertical plane. The vertical plane, in the installation position, extends vertically and is spaced apart from the lateral surface of the outflow pipe at a distance of at most the outer diameter of the outflow pipe or of at most half the outer diameter of the outflow pipe. The vertical plane is parallel to the first central axis and parallel to the second central axis or to the outflow pipe central axis.

Preferably, the structural space can be bounded downwardly by a lower plane. The lower plane extends at right angles to the vertical plane and extends through a lower lateral surface line, which forms the line of intersection of a central plane, extending through the outflow pipe central axis and vertically, with the pipe outer side.

The structural space can be bounded upwardly by an upper plane. The upper plane extends at right angles to the vertical plane and extends through an upper lateral surface line, which forms the line of intersection of a central plane, extending through the outflow pipe central axis, with the pipe outer side.

Preferably, the actuator element is an actuating rod or a cable.

Further embodiments are specified in the dependent claims.

BRIEF DESCRIPTION OF THE DRAWINGS

Preferred embodiments of the invention will be described below on the basis of the drawings, which serve merely for explanation and should not be interpreted as being restrictive. In the drawings.

DESCRIPTION OF PREFERRED EMBODIMENTS

Figure 8:
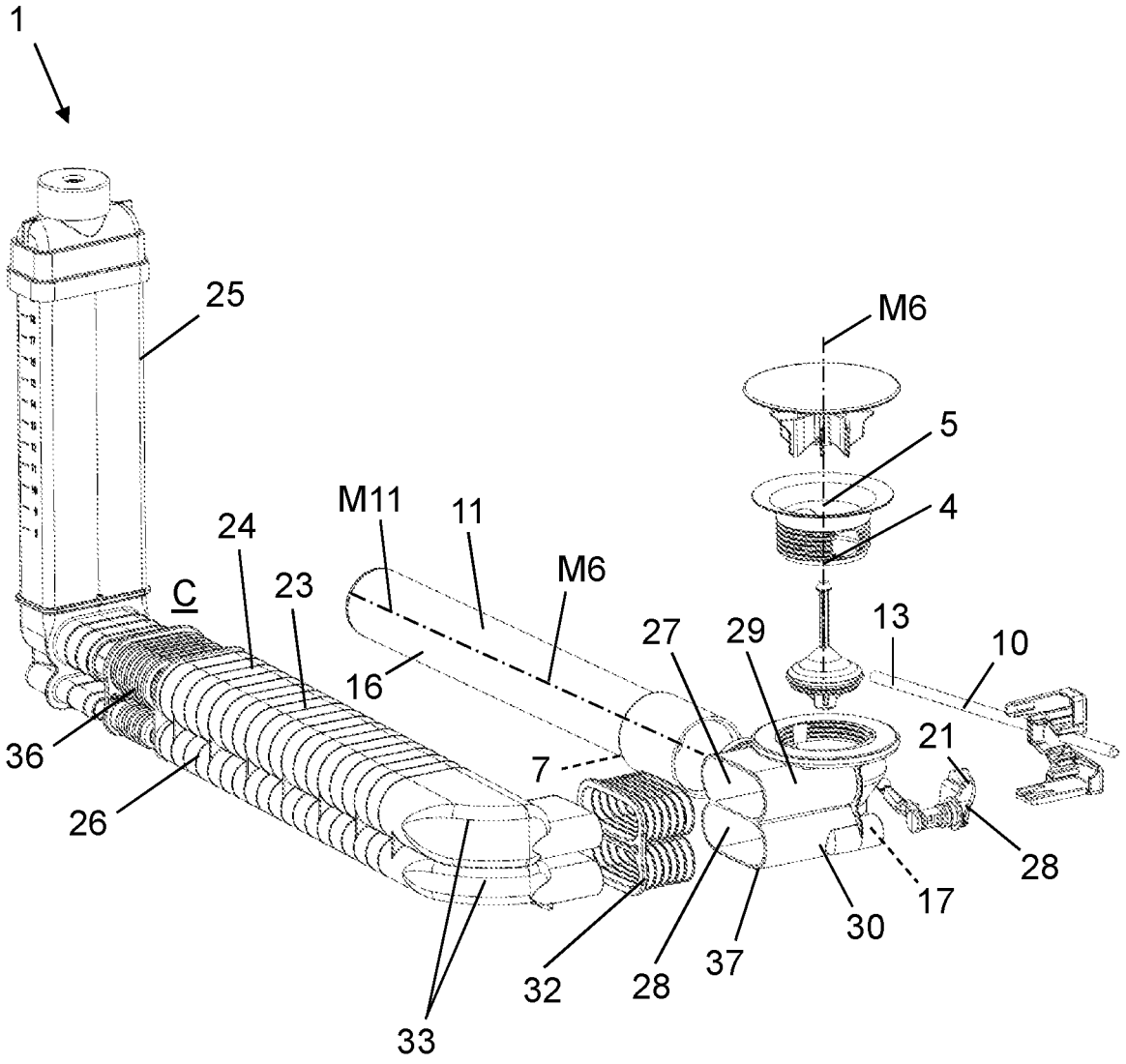
FIG. 8 shows a further exploded illustration of the drain arrangement according to FIG. 1.
Figure 9:
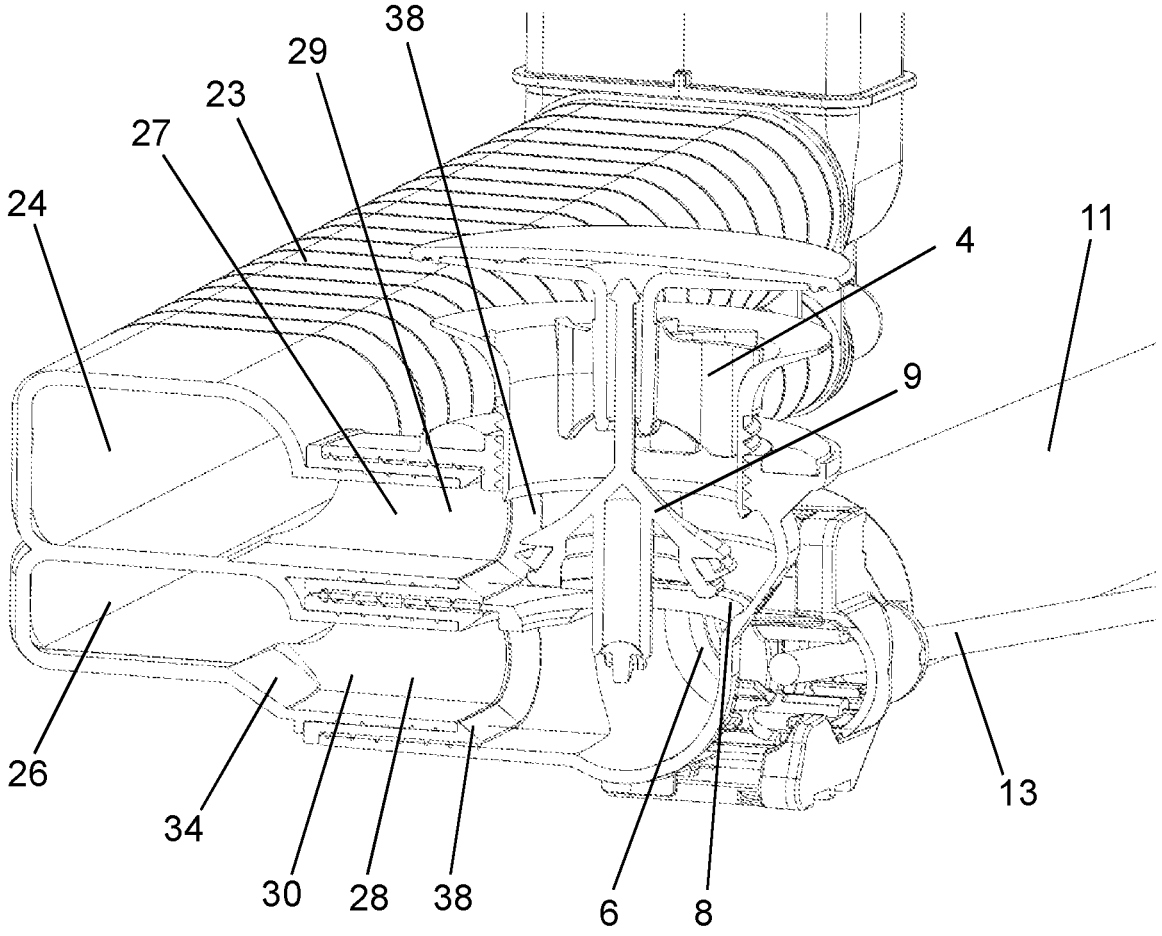
FIG. 9 shows a further sectional illustration of the drain arrangement according to FIG. 1.
Figure 10:
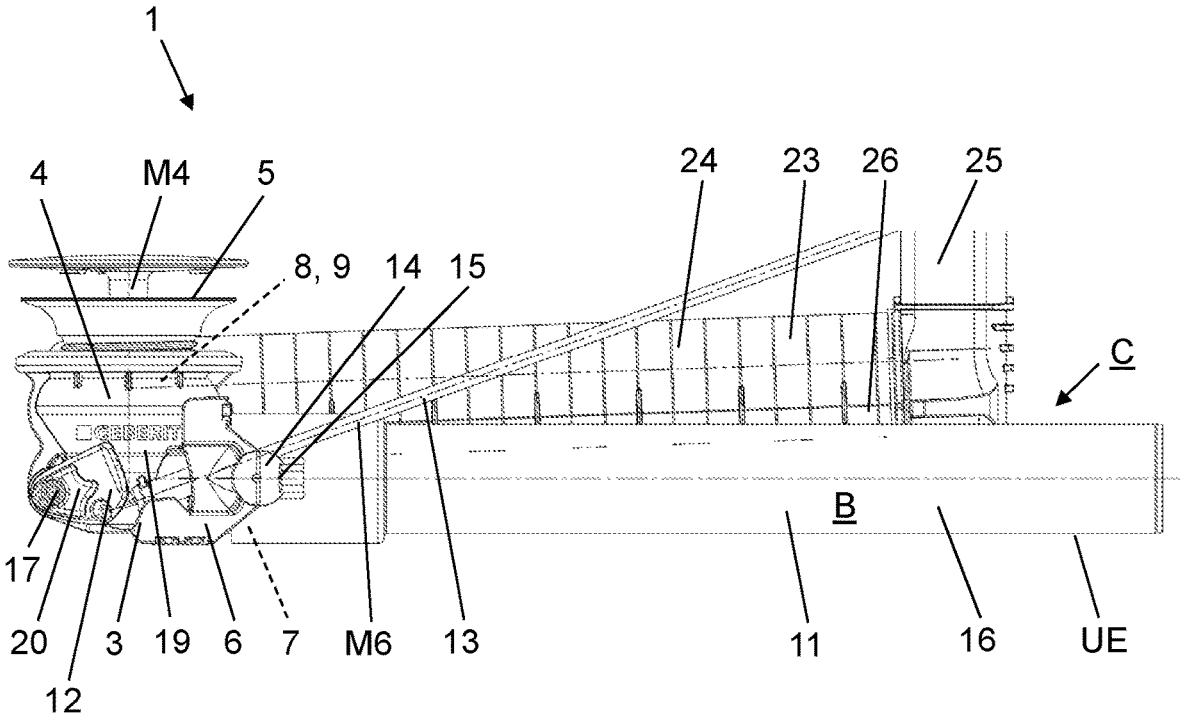
FIG. 10 shows a side view of the second embodiment with another actuating element.

FIGS. 1 to 10 show various views of a preferred embodiment of a drain arrangement according to the invention. FIGS. 1 to 9 show a first variant of the preferred embodiment, and FIG. 10 shows a variant thereof.

The drain valve arrangement 1 serves for connection to a sanitary item 2. The sanitary item 2 is preferably a washbasin or a sink. The drain arrangement 1 comprises a drain valve housing 3 having a first channel section 4 with an inlet opening 5, having a second channel section 6 with an outlet opening 7, and having a valve seat 8 situated between the inlet opening 5 and the outlet opening 7. The drain valve arrangement 1 furthermore comprises a valve body 9 which is movable from the valve seat 8 from a closed position into an open position and back. The valve body 9 is moved from the closed position into the open position by way of an actuating unit 10. The drain valve arrangement 1 furthermore comprises an outflow pipe 11 into which the second channel section 6 opens by way of the outlet opening 7 thereof. Via the outflow pipe 11, water can be conducted away from the second channel section 6.

A first central axis M4 extends centrally through the first channel section 4. In the installation position, the first central axis M4 is substantially vertical, that is to say in the plumb-line direction. An outflow pipe central axis M11 extends centrally through the outflow pipe 11. In the installation position, the outflow pipe central axis M11 is substantially horizontal or is downwardly inclined at an angle in relation to the horizontal so that water can be conveyed away from the drain valve housing 3 through the outflow pipe. The second channel section 6 has a second central axis M6.

In the embodiments shown, the outflow pipe central axis M11 intersects the first central axis M4. That is to say, the central axis M11 and the central axis M4 lie in a common plane, which may be referred to as central plane ME. The outflow pipe central axis M11 may however also be at a distance from the first central axis M4, wherein said distance corresponds at most to half the diameter of the outlet opening 7.

The drain arrangement 1 furthermore comprises an overflow unit 23. By way of the overflow unit 23, an emergency overflow can be provided if the valve body 9 is in the closed position. The overflow unit 23 has a first connecting pipe 24, an overflow pipe 25 and a second connecting pipe 26. The first connecting pipe 24 is led, from an upper mouth opening 27, out of the first channel section 4 from above the valve seat 8. The mouth opening 27 forms an aperture through the side wall 19 of the drain valve housing 3. The first connecting pipe 24 opens into the overflow pipe 25, which, in the installation position, extends upwards substantially counter to the plumb-line direction. An overflow edge is arranged in the interior of the overflow pipe 25. The overflow pipe 25 then opens, below the first connecting pipe 24, into the second connecting pipe 26. The second connecting pipe 26 opens, below the valve seat 8, into the first channel section 4 via a lower mouth opening 28. The lower mouth opening 28 likewise forms an aperture through the side wall 19.

The mouth openings 27, 28 open into the outflow valve housing 3 laterally with respect to the outflow valve housing 3. Despite this, the outflow pipe 11 opens into the outflow valve housing 3 laterally with respect to the outflow valve housing 3. This opening in a lateral manner yields the advantage that the drain arrangement can be formed highly compactly in the downward direction.

In the embodiment shown, the mouth openings 27, 28 are provided by in each case one mouth channel section 29, 30. The mouth channel sections 29, 30 extend, as can be clearly seen in FIG. 8, laterally away from the outflow valve housing 3. The mouth channel sections 29, 30 are inclined at an angle to the outflow pipe central axis M11. In the embodiment shown, the angle is a right angle. Other angles in the range from 45° to 135° are likewise conceivable.

The mouth openings 27, 28 are delimited at a face side by side edges 37. The side edges 37 lie in a plane which is parallel or at an angle of at most 45° to a central plane ME extending through the first central axis M4 and the pipe central axis M11.

Figure 1:
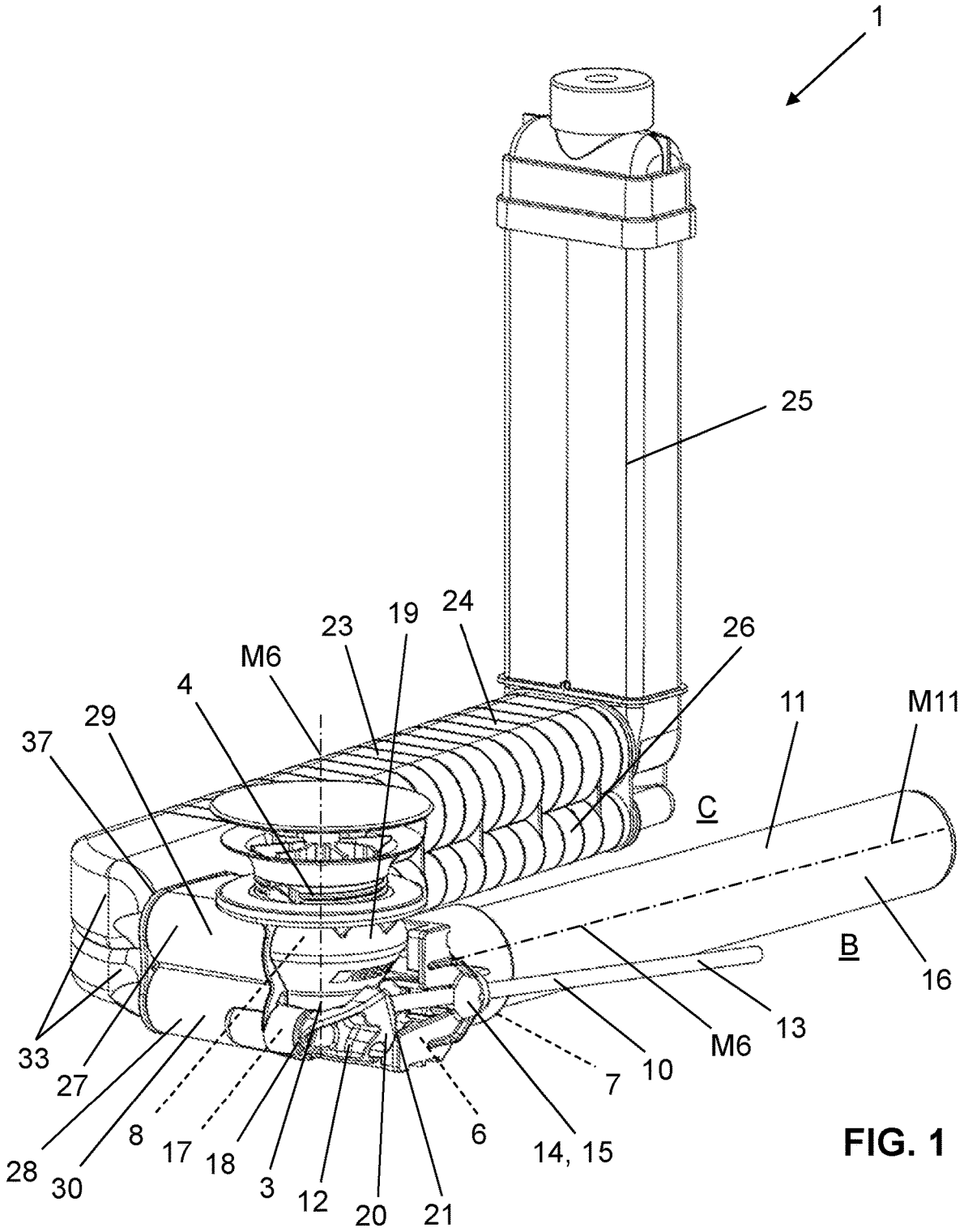
FIG. 1 shows a perspective view of a drain valve arrangement according to an embodiment of the present invention.
Figure 2:
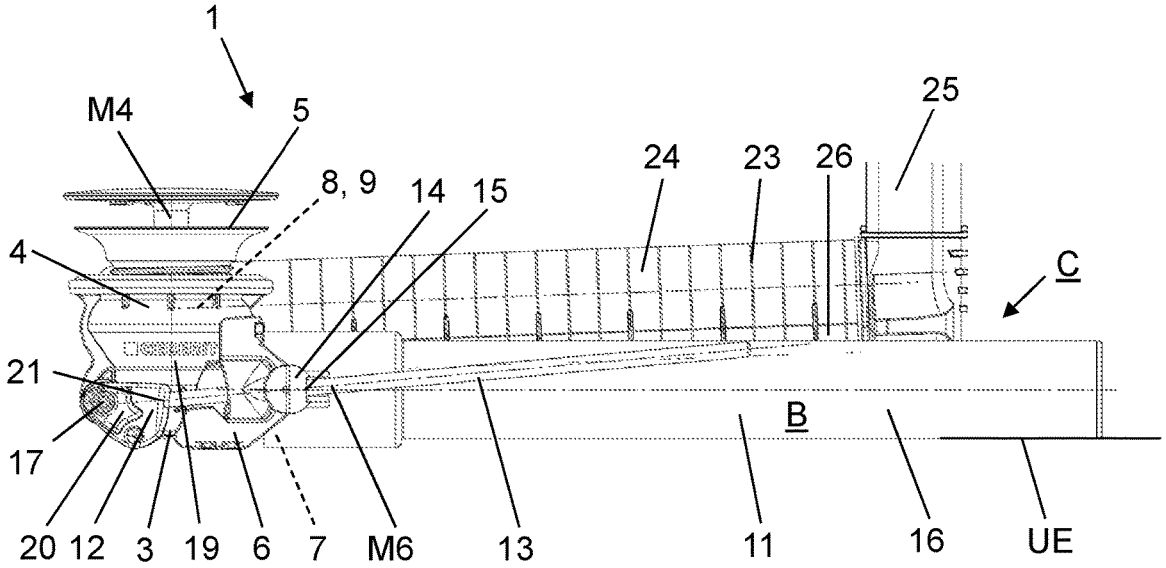
FIG. 2 shows a side view of the drain arrangement according to FIG. 1 in the closed position.
Figure 3:
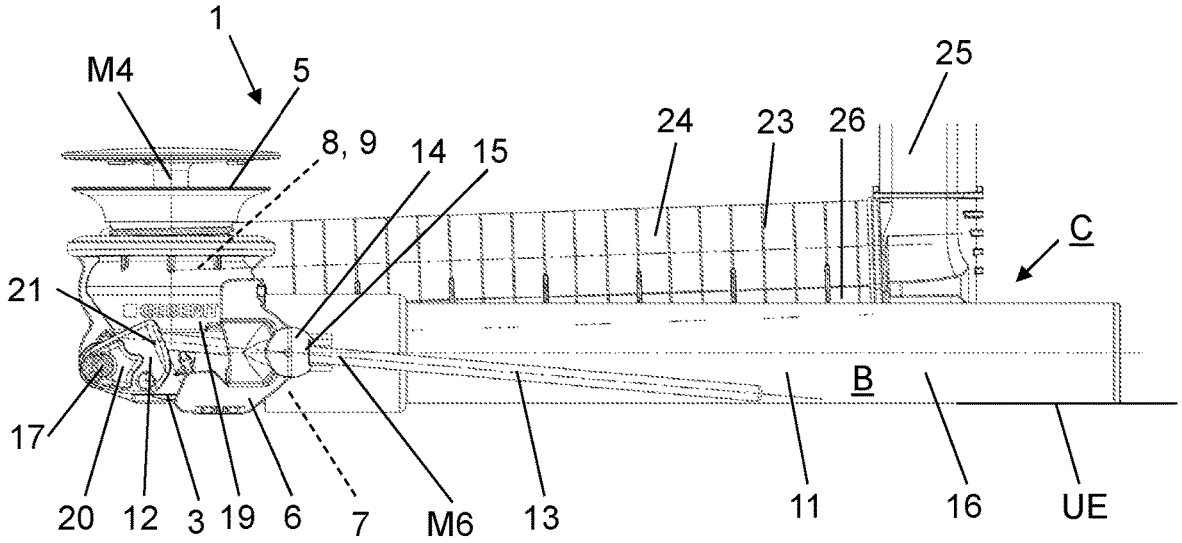
FIG. 3 shows a side view of the drain arrangement according to FIG. 1 in the open position.

As can be seen in all the figures, the two connecting pipes 24, 26 extend laterally alongside the outflow pipe 11, wherein, as seen in the installation position from above, the connecting pipe central axes M24, M26 are parallel to the outflow pipe central axis M11. FIGS. 2 and 3 show the orientation of the two connecting pipes 24, 26. In the installation position, the connecting pipe central axes M24, M26 are inclined at an angle with respect to a horizontal plane HE, wherein the connecting pipes 24, 26 descend towards the mouth openings 27, 28. In other words, the connecting pipe central axes M24, M26 are inclined at an angle to the outflow pipe central axis M11.

Furthermore, a diversion section 33 is provided between the mouth openings 27, 28 and the respective connecting pipe 24, 26. In the embodiment shown, the diversion section 33 is part of the connecting pipe 24, 26.

The connecting pipes 24, 26 each project with a pipe section 31 into the mouth openings 27, 28. In each case one seal 32 is arranged between the pipe sections 31 and the mouth openings 27, 28.

The overflow pipe 25 projects, in each case with a pipe section 35, into the connecting pipes 24, 26. In each case one seal 36 is arranged between the pipe sections 35 and the connecting pipes 24, 26.

Figure 7:
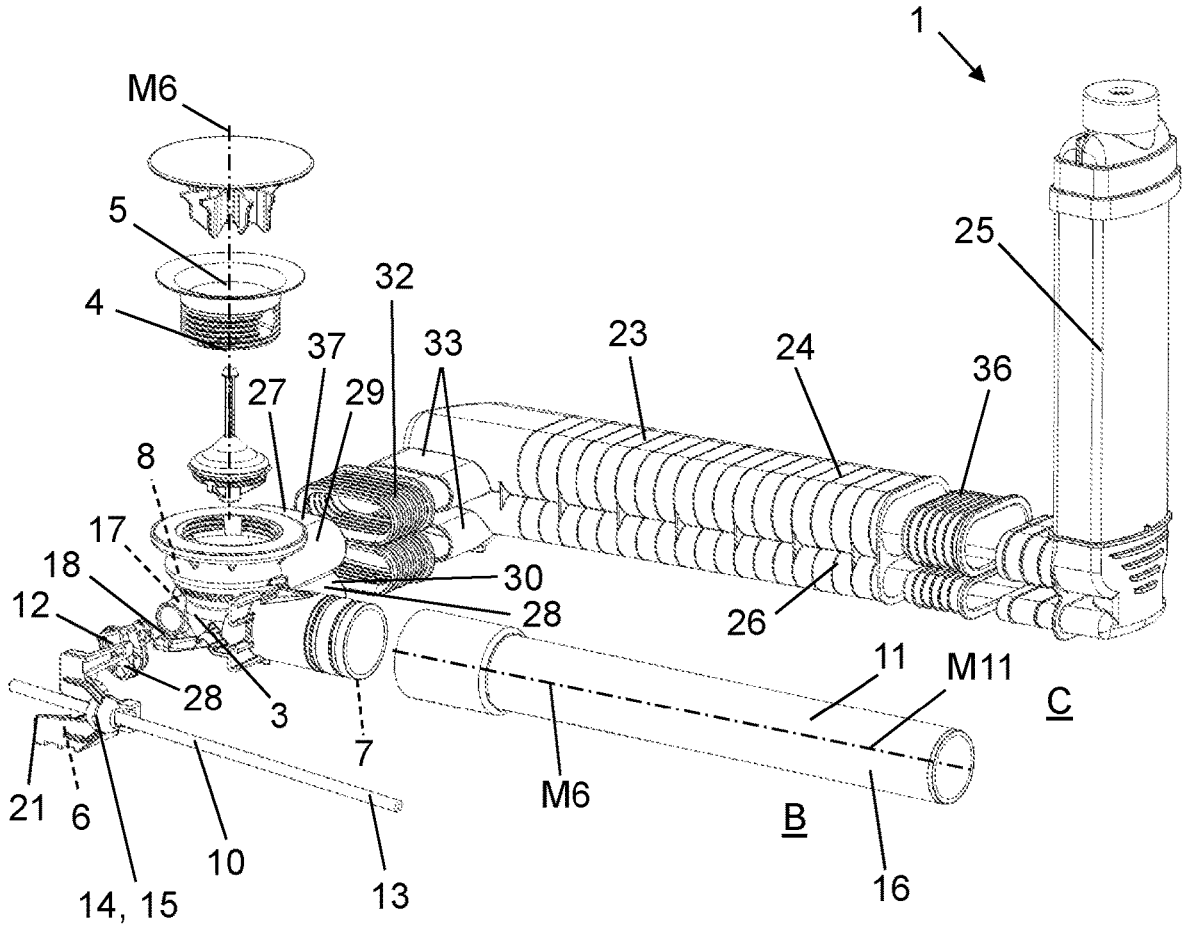
FIG. 7 shows an exploded illustration of the drain arrangement according to FIG. 1.

FIGS. 7 and 8 show the seals 32 and 36. The seals 32, 36 are preferably formed integrally and in such a way that, for each side, the sealing action can be provided by one element, that is to say by one seal.

The first connecting pipe 24 and the second connecting pipe 26 are preferably formed as an integral structure.

FIG. 9 shows in relatively great detail a sectioned illustration of the outflow valve housing 3 and of the opening points of the two connecting pipes 24, 26.

The seal 32 has a section 38 which is exposed in the mouth opening 27, 28, wherein the section 38 is in the form of an angled surface. The angled surface has the advantage of it being possible to reduce the flow resistance at the transition from the connecting pipe 24, 26, which is advantageous for the overflow performance.

Furthermore, before the entry into the first channel section, the second connecting pipe 26 has a shoulder 34 which is oriented downwards in the direction of gravitational force. The shoulder 34 has the advantage that water flowing over the shoulder 34 in the direction of the drain valve housing 3 is accelerated in the region of the shoulder 34. Moreover, as a result of the shoulder 34, the second connecting pipe 26 can be arranged higher up in terms of its position.

The actuating unit 10 has an actuating lever 12, which acts on the valve body 9, and an actuator element 13 for actuating the actuating lever 12. In the embodiment shown, the actuating lever 12 projects into the interior of the drain valve housing 3 through a side wall 19 from outside the drain valve housing 3. The actuator element 13 is arranged outside the outflow pipe 11 and, at least over a section, extends laterally alongside the outflow pipe 11. The actuator element is in the form of an actuating rod in the variant in FIGS. 1 to 9 and in the form of a cable pull in the variant in FIG. 10.

The expression "laterally alongside the outflow pipe 11" is to be understood as meaning that, in the installation position, the actuator element 13 is, over said section, situated alongside the outflow pipe 11 and not below or above the pipe. The overflow unit 23 extends on the side opposite the actuator element 13, that is to say on the other side of the outflow pipe. This position of the actuator element 11 is specified in even greater detail further below on the basis of a structural space.

The lateral arrangement of the overflow unit 23 and the actuator element 13, in each case alongside the outflow pipe, has, as is shown in the figures, the advantage that a compact drain arrangement 1 can be provided. This applies in particular with the condition of an advantageous pipeline in relation to flow losses. In the embodiment shown, the drain arrangement 1 has only a single diversion, specifically in the transition from the first channel section 4 to the second channel section 6. Subsequently, the outflow pipe 11, which is of rectilinear form here, extends directly from the second channel section 6. This has the advantage that the flow losses during the outflow of the water are low. Furthermore, the arrangement of the overflow unit 23 and of the actuator element 13 alongside the outflow pipe yields the advantage that the drain valve arrangement is formed with a small structural height in the downward direction.

In said section extending laterally with respect to the outflow pipe 11, the actuator element 13 extends at a distance A laterally with respect to the outflow pipe 11. The distance A is selected to be as small as possible. In particular, the distance A is less than the outer diameter D or less than half the outer diameter D of the outflow pipe 11.

In all the embodiments, the actuator element 13 is mounted in a bearing point 14 situated on the outside of the drain valve housing. The bearing point 14 is likewise situated laterally with respect to the outflow valve housing 3. Here, the bearing point 14 has a bearing opening 15 for the passing-through of the actuator element 13. If the actuator element 13 is an actuating rod, then the bearing point 14 is formed with the bearing opening 15 in such a way that pivoting of the rod around a pivot axle S is possible. If the actuator element is a cable pull, the bearing opening serves for the passing-through of the cable. In a preferred embodiment of the drain valve arrangement, it is possible, as shown in the figures, for two bearing openings to be arranged such that either the actuating rod or the cable pull can be led through the bearing opening.

In the installation position, the bearing point 14 or the bearing opening 15 is situated at a height which is substantially central with respect to the outflow pipe 11. That is to say, in the installation position, the bearing point 14 or the bearing opening 15 is situated substantially at the height of the central axis M6 of the second channel section.

The structural space B in which the actuator element 13 and those parts of the actuating lever which are situated outside the drain valve housing 3 are situated will now be explained in more detail on the basis of FIG. 4. The structural space C for the overflow unit 23 will likewise be explained in more detail.

The structural space B is bounded laterally by a vertical plane VE. The vertical plane VE, in the installation position, extends vertically and extends parallel to the outflow pipe central axis M11 and to the first central axis M4 and to the second central axis M6. The vertical plane is at a distance from the lateral surface of the outflow pipe 11. The distance is denoted by the reference sign A. The distance A corresponds at most to the outer diameter D of the outflow pipe 11.

The structural space B is bounded downwardly by a lower plane UE. The lower plane UE extends at right angles to the vertical plane VE. The lower plane UE furthermore extends through a lower lateral surface line UM. The lower lateral surface line UM is the line of intersection of a central plane ME extending through the outflow pipe central axis M11 and vertically. The central plane ME extends parallel to the vertical plane VE.

In the variant in which the outflow pipe central axis M11 intersects the first central axis M4, the central plane ME also extends through the first central axis M4 and through the second central axis M6. In other words, the central plane ME is spanned by the outflow pipe central axis M11, the first central axis M4 and the second central axis M6. In the variant in which the outflow pipe central axis M11 is at a distance from the first central axis M4, the central plane extends spaced apart from and parallel to the first central axis M4.

The structural space B is bounded upwardly by an upper plane OE. The upper plane OE extends at right angles to the vertical plane VE. The upper plane OE furthermore extends through an upper lateral surface line OM. The upper lateral surface line OM is the line of intersection of the central plane ME defined above.

Figure 4:
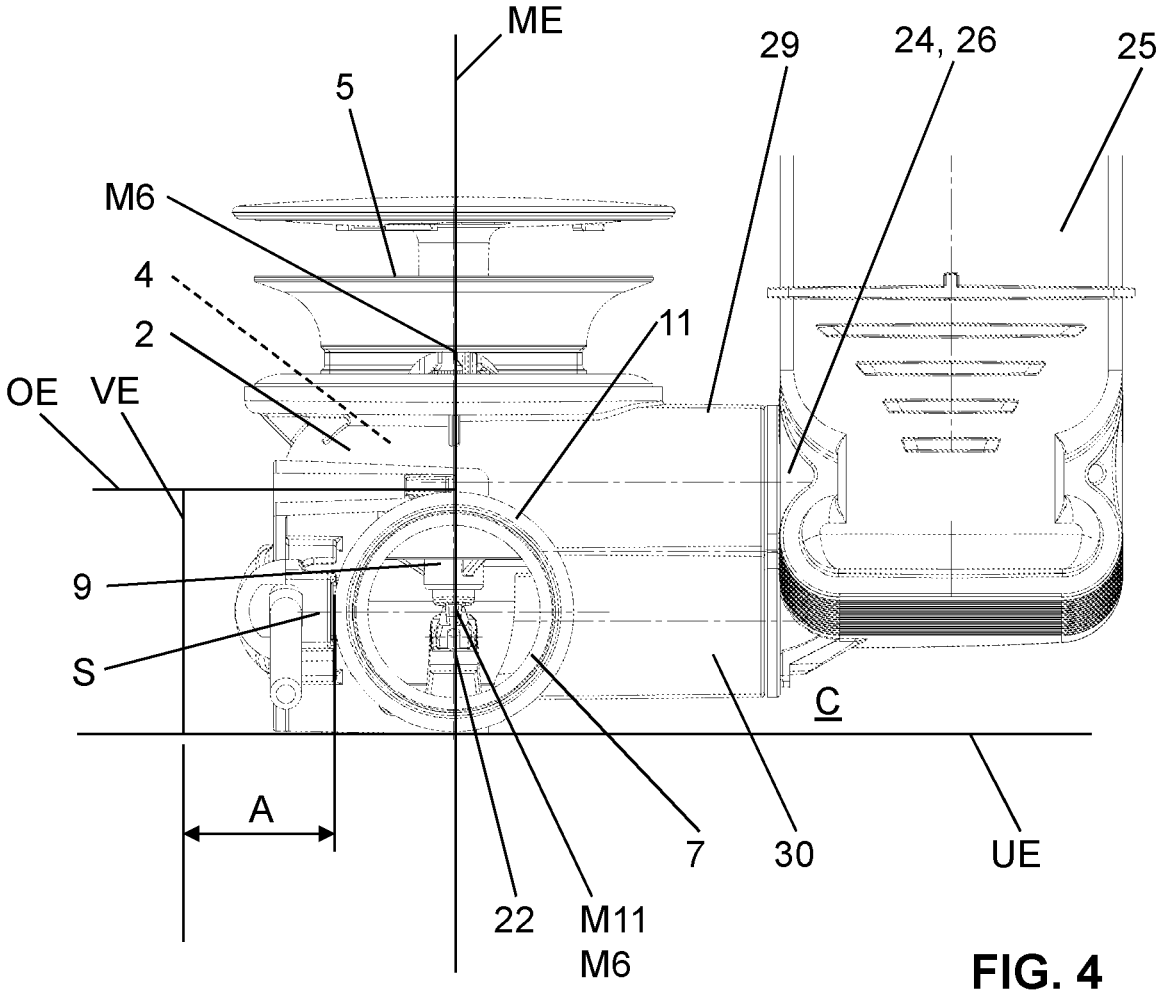
FIG. 4 shows a front view of the drain arrangement according to FIG. 1.

As shown in FIG. 4, the structural space B extends laterally alongside the outflow pipe 11, wherein the structural space B spatially closely adjoins the outflow pipe 11.

Those elements of the actuating unit 10 which are situated outside the drain valve housing 3 are, as described, situated in the structural space B. The upper plane OE is passed through by the actuator element 13 according to the form of the actuator element 13. In the embodiment of the actuator element 13 in the form of an actuating rod, the actuating rod, as shown in FIGS. 1 to 9, extends in said structural space B or below the upper plane OE substantially over the whole length of the outflow pipe 11. The actuator element 13 passes through the structural space B in the end region of the outflow pipe 11 opposite the drain valve housing 3. In the embodiment of the actuator element 13 in the form of a cable pull, the cable pull can pass through the upper plane OE at a less distant point. In both variants, however, the actuator element 13 is situated in such a way that the lower plane UE and the vertical plane VE are not passed through.

The structural space C in which the overflow unit 23 is situated extends laterally with respect to the outflow pipe 11 in the upward direction. In the installation position, the structural space C is bounded downwardly by a lower plane UE. The lower plane UE extends at right angles to a central plane ME, which is spanned by the first central axis M4 and the second central axis M6, and extends through a lower lateral surface line UM, which forms the line of intersection of a vertical plane VE, extending through the outflow pipe central axis M11 and vertically, with the pipe outer side.

Figure 5:
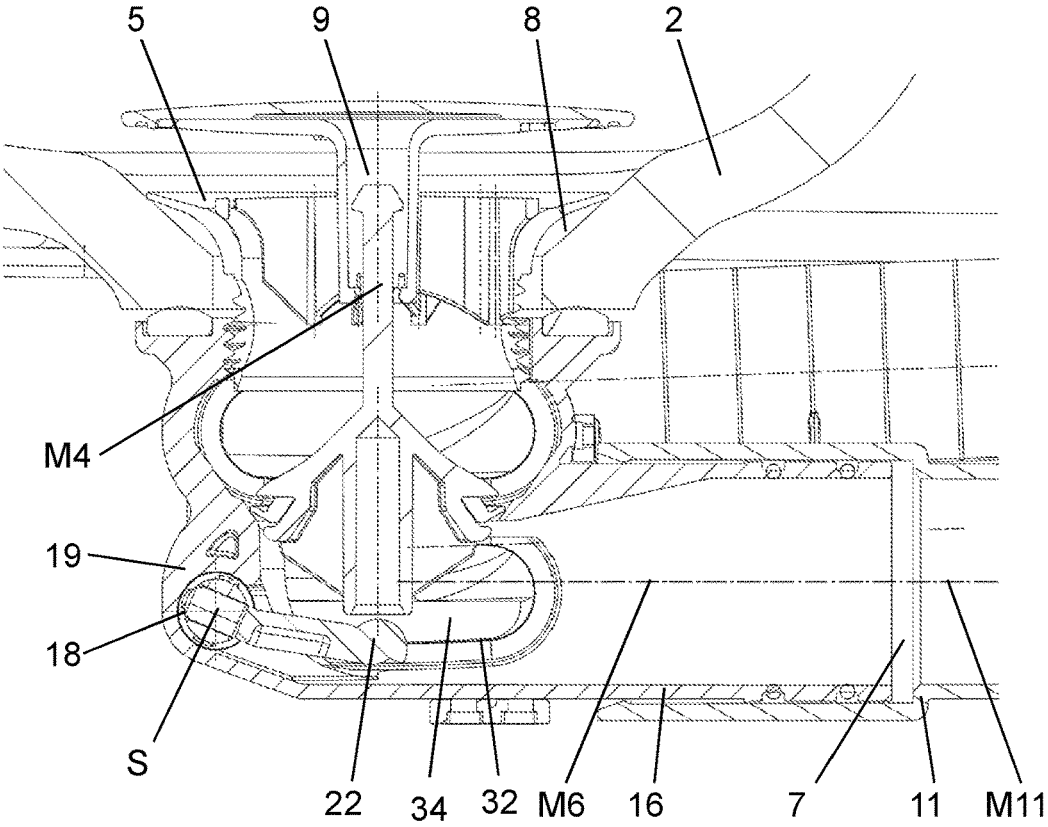
FIG. 5 shows a side view of the drain arrangement according to FIG. 1 in the closed position.
Figure 6:
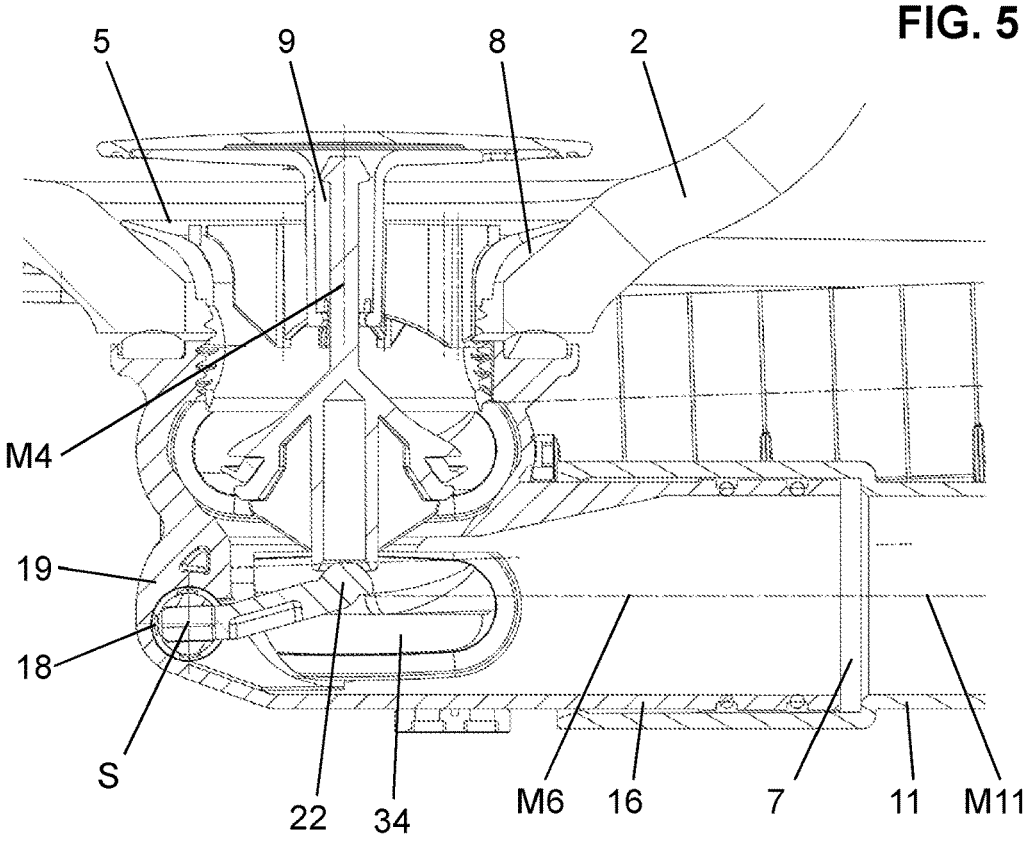
FIG. 6 shows a side view of the drain arrangement according to FIG. 1 in the open position.

It can be clearly seen from the sectional illustrations in FIGS. 5 and 6 that the actuating lever 12 has a lever arm 22 which acts on the valve body 9. The actuating lever 12 is pivoted around the lever axle 17 by the actuator element 13 and in the process lifts the valve body 9 from the closed position, as shown in FIG. 5, into the open position, as shown in FIG. 6.

The lever axle 17 is mounted in a bearing point 18 in a side wall 19 of the outflow valve housing 3, wherein the lever axle 17 projects out of the outflow valve housing 3, and wherein the lever axle 17 has, in particular at an end side, a lever projection 20 with an articulation point 21 on which the actuator element 13 acts. The lever projection 20 and the articulation point 21 are likewise situated in said structural space B.

| LIST OF REFERENCE SIGNS | |
|---|---|
| 1 | Drain valve arrangement |
| 2 | Sanitary item |
| 3 | Drain valve housing |
| 4 | First channel section |
| 5 | Inlet opening |
| 6 | Second channel section |
| 7 | Outlet opening |
| 8 | Valve seat |
| 9 | Valve body |
| 10 | Actuating unit |
| 11 | Outflow pipe |

-continued

| LIST OF REFERENCE SIGNS | |
|---|---|
| 12 | Actuating lever |
| 13 | Actuator element |
| 14 | Bearing point |
| 15 | Bearing opening |
| 16 | Lateral surface |
| 17 | Lever axle |
| 18 | Bearing point |
| 19 | Side wall |
| 20 | Lever projection |
| 21 | Articulation point |
| 22 | Lever arm |
| 23 | Overflow unit |
| 24 | First connecting pipe |
| 25 | Overflow pipe |
| 26 | Second connecting pipe |
| 27 | Upper mouth opening |
| 28 | Lower mouth opening |
| 29 | Mouth channel section |
| 30 | Mouth channel section |
| 31 | Pipe section |
| 32 | Seal |
| 33 | Diversion section |
| 34 | Shoulder |
| 35 | Pipe section |
| 36 | Seal |
| 37 | Side edges |
| 38 | Section |
| A | Distance |
| B | Structural space |
| C | Structural space |
| M4 | Central axis, first channel section |
| M6 | Central axis, second channel section |
| M11 | Central axis, outflow pipe |
| VE | Vertical plane |
| ME | Central plane |
| OE | Upper plane |
| UE | Lower plane |
| OM | Upper lateral surface line |
| UM | Lower lateral surface line |
| S | Pivot axle |

The invention claimed is:

1. A drain arrangement for connection to a sanitary item, comprising:

a drain valve housing which has a first channel section with an inlet opening, has a second channel section with an outlet opening, which emerges laterally from the outflow valve housing, and has a valve seat situated between the inlet opening and the outlet opening;

a valve body which is movable from the valve seat from a closed position into an open position;

an actuating unit by way of which the valve body is movable; and an outflow pipe which follows the outlet opening, wherein a first central axis extends centrally through the first channel section, and an outflow pipe central axis extends centrally through the outflow pipe, wherein the outflow pipe central axis intersects the first central axis, or wherein the outflow pipe central axis is at a distance from the first central axis, wherein the distance corresponds at most to half the diameter of the outlet opening, wherein the drain arrangement furthermore comprises an overflow unit, which has a first connecting pipe, an overflow pipe and a second connecting pipe, wherein the first connecting pipe is led, from an upper mouth opening, out of the first channel section from above the valve seat and opens into the overflow pipe, which, in the installation position, extends upwards substantially counter to the plumb-line direction, and wherein the overflow pipe opens, below the first connecting pipe, into the second connecting pipe, which opens, below the valve seat, into the first channel section, and/or the second channel section, via a lower mouth opening, and wherein both the outlet opening and the mouth openings are arranged at the outflow housing laterally with respect to the outflow valve housing, in such a way that, as seen in the installation position, the outflow pipe and the connecting pipes extend substantially next to one another.

2. The drain arrangement according to claim 1, wherein the mouth openings are provided by in each case one mouth channel section, which mouth channel section extends in a manner inclined at an angle to the outflow pipe central axis.

3. The drain arrangement according to claim 1, wherein the mouth openings are delimited at a face side by side edges which lie in a plane which is parallel or at an angle of at most 45° to a central plane extending through the first central axis and the pipe central axis.

4. The drain arrangement according to claim 1, wherein the two connecting pipes extend laterally alongside and spaced apart from the outflow pipe, and wherein, as seen in the installation position from above, the connecting pipe central axes are parallel to the outflow pipe central axis.

5. The drain arrangement according to claim 1, wherein the connecting pipes each project with a pipe section into the mouth openings.

6. The drain arrangement according to claim 5, wherein in each case a seal is arranged between the pipe sections and the mouth openings.

7. The drain arrangement according to claim 5, wherein in each case a seal is arranged between the pipe sections and the mouth openings, wherein the seal has a section which is exposed in the mouth opening, and wherein the section is in the form of an angled surface.

8. The drain arrangement according to claim 1, wherein a diversion section is provided between the mouth opening and the respective connecting pipe, and wherein the diversion section is part of the mouth opening and/or part of the connecting pipe.

9. The drain arrangement according to claim 1, wherein, in the installation position, the connecting pipe central axes are inclined at an angle with respect to a horizontal plane, and wherein the connecting pipes descend towards the mouth openings.

10. The drain arrangement according to claim 1, wherein, before the entry into the first channel section, the second connecting pipe and/or the lower mouth opening have/has a shoulder which is oriented downwards in the direction of gravitational force.

11. The drain arrangement according to claim 1, wherein the overflow unit is situated in a structural space, which structural space extends laterally with respect to the outflow pipe in the upward direction, wherein, in the installation position, the structural space is bounded downwardly by a lower plane, and wherein the lower plane extends at right angles to a central plane, which is spanned by the first central axis and the second central axis, and extends through a lower lateral surface line, which forms the line of intersection of a vertical plane, extending through the outflow pipe central axis and vertically, with the pipe outer side.

12. The drain arrangement according claim 1, wherein the actuating unit has an actuating lever, which acts on the valve body, and an actuator element for actuating the actuating lever, and wherein the actuator element, at least over a section, extends laterally alongside the outflow pipe.

13. The drain arrangement according to claim 12, wherein the actuator element is situated on one side of the outflow pipe, and wherein the two connecting pipes and also the overflow pipe are situated on the other side of the outflow pipe.

14. The drain arrangement according to claim 12, wherein the mouth openings are, in relation to a central plane spanned by the first central axis and the second central axis, situated opposite the actuator element.

15. The drain arrangement according to claim 12, wherein the actuator element is situated on one side of the outflow pipe, wherein the two connecting pipes and also the overflow pipe are situated on the other side of the outflow pipe, and wherein the mouth openings are, in relation to a central plane spanned by the first central axis and the second central axis, situated opposite the actuator element.

16. The drain arrangement according to claim 1, wherein the actuator element is situated spaced apart laterally at a distance from the lateral surface of the outflow pipe, wherein the distance is less than the outer diameter of the outflow pipe or less than half the outer diameter of the outflow pipe.

17. The drain arrangement according to claim 1, wherein the outflow pipe (11) extends along a straight line without curvature; and/or wherein a siphon follows the outflow pipe (11) opposite the second channel section (6).

18. The drain arrangement according to claim 2, wherein said angle is an angle of 45° to 135°.

19. The drain arrangement according to claim 2, wherein said angle is an angle of 90°.

* * * * *